US008256622B2

(12) United States Patent
Ahlberg

(10) Patent No.: US 8,256,622 B2
(45) Date of Patent: Sep. 4, 2012

(54) COMBINED TRANSPORT AND EXHIBITION DEVICE

(76) Inventor: Christian Ahlberg, Sollentuna (SE)

( * ) Notice: Subject to any disclaimer, the term of this patent is extended or adjusted under 35 U.S.C. 154(b) by 0 days.

(21) Appl. No.: 12/855,731

(22) Filed: Aug. 13, 2010

(65) Prior Publication Data

US 2012/0037518 A1 Feb. 16, 2012

(51) Int. Cl.
*B65D 5/52* (2006.01)

(52) U.S. Cl. ..... 206/736; 206/216

(58) Field of Classification Search ..... 206/45.2, 206/45.24, 216, 223, 736; 220/629, 647; 248/692

See application file for complete search history.

(56) References Cited

U.S. PATENT DOCUMENTS

| | | | | |
|---|---|---|---|---|
| 2,119,799 | A * | 6/1938 | Sivey | 220/4.28 |
| 2,277,674 | A * | 3/1942 | Belsinger | 206/586 |
| 4,581,902 | A | 4/1986 | Starck et al. | |
| 4,706,817 | A * | 11/1987 | Greathouse | 206/545 |
| 6,318,713 | B1 * | 11/2001 | Levi | 206/736 |
| 7,546,927 | B2 * | 6/2009 | Lowry et al. | 206/594 |
| 2001/0001195 | A1 | 5/2001 | Ahlberg | |
| 2009/0078593 | A1 * | 3/2009 | Patstone | 206/216 |

FOREIGN PATENT DOCUMENTS

| | | | |
|---|---|---|---|
| CA | 2156723 | Y | 2/1994 |
| CN | 2393837 | Y | 8/2000 |
| JP | 57085226 | U | 5/1982 |
| WO | 9743932 | A1 | 11/1997 |

OTHER PUBLICATIONS

European Search Report dated Sep. 27, 2010.
Swedish Office Communication (dated Feb. 16, 2011).

* cited by examiner

*Primary Examiner* — Luan K Bui
(74) *Attorney, Agent, or Firm* — Jeffrey S. Melcher; Manelli Selter PLLC

(57) ABSTRACT

The present invention is related to a combined transport and exhibition device (1) for an exhibition stand comprising two matching shell portions (2, 3) and at least two clasp means (2*a*, 3*a*) provided on each shell portion to keep said shell portions together and interacting to form a storage space (4) when mounted as a transport unit. The device (1) includes at least two bars (13) which are connectable to two oppositely arranged clasp means (2*a*, 3*a*) on each shell portion (2, 3) when mounted as a display unit.

12 Claims, 3 Drawing Sheets

COMBINED TRANSPORT AND EXHIBITION DEVICE

TECHNICAL FIELD

The present invention is related to a combined transport and exhibition device for an exhibition stand according to the pre-characterizing portion.

BACKGROUND OF THE INVENTION

Such combined transport and exhibition device for an exhibition stand are known from WO 97/43932 and CN 2393837. Normally combined transport and exhibition devices are bulky and are not easy to handle. Hence, above all such devices are rather heavy which make them uncomfortable when used as a transport equipment.

OBJECT OF THE INVENTION

An object of the invention is to provide a combined transport and exhibition device which overcomes the drawbacks of the known devices and which is reliable as to its function and has a simple design.

Another object of the invention is to provide an easy to mount device which easy to mount as a transport device as well as a display unit for an exhibition stand.

SUMMARY OF THE INVENTION

The above objects are achieved by means of a combined transport and exhibition device having the features of the claimed invention.

The sub claims define preferred embodiments of the invention.

The combined transport and exhibition device according to the invention can be used in a more convenient way than the known devices. It is easier to pack it since the board which is situated at the middle of the storage space, when it is mounted as a transport unit, can be removed and then put back resting on a peripherally extending inner flange at the ridge of the bottom shell portion. The other shell portion has a similar flange so that when mounting the shell portions together to one unit the board is clamped between the flanges and makes the whole unite more stable.

Another advantage with the combined transport and exhibition device according to the invention is that the clasps which are used to tighten the shell portions, when used as a transport unit, are also used to mount the bars between the shell portions, when used as a display unit.

Further advantages will be apparent from the description below.

BRIEF DESCRIPTION OF THE DRAWINGS

The invention will be described in closer detail in the following by way of a preferred embodiment thereof with reference to the annexed drawings.

DESCRIPTION OF PREFERRED EMBODIMENTS

In FIGS. 1-11 a preferred embodiment of a combined transport and exhibition device 1 according to the invention for an exhibition stand is shown in different mounting positions. In FIGS. 1, 2, 7, 8 and 9 the combined transport and exhibition device 1 is shown when mounted as a transport unit with storage possibilities for exhibition materials or the like. In FIGS. 3-6, 10 and 11 the combined transport and exhibition device 1 is shown when mounted as a display unit to be used as, e.g., a podium at a an exhibition stand or the like.

Figure 1:
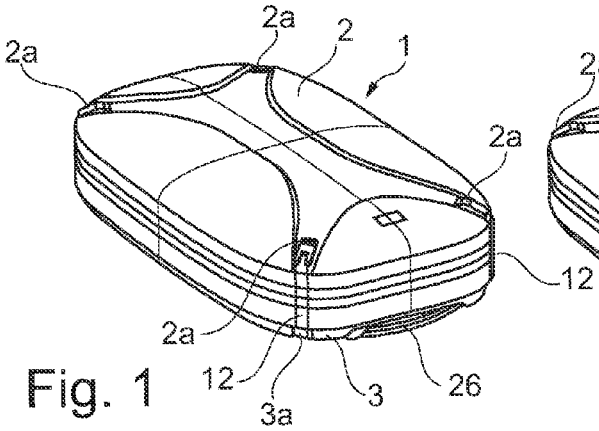
FIG. 1 is a perspective view from above of a combined transport and exhibition device for an exhibition stand according to the invention mounted as a transport unit.
Figure 2:
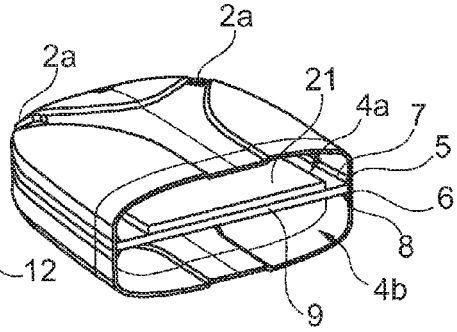
FIG. 2 is a cross-sectional view through the middle of the combined transport and exhibition device of FIG. 1.

The combined transport and exhibition device 1 comprises two matching shell portions 2 and 3 and four clasps 2*a* and 3*a*, respectively, provided on each shell portion 2, 3 to keep the shell portions together when mounted as transport unit. The clasps 2*a* and 3*a* are positioned at the corners of the shell portions 2, 3 which have a substantially rectangular form with curved corners and slightly curved sides. When the shell portions 2, 3 are assembled, e.g., as shown in FIGS. 1 and 2, they interact to form two storage compartments 4*a* and 4*b* therebetween. The shell portions 2, 3 are substantially identical to their shape and are trough-shaped to form the storage compartments 4*a*, 4*b*. The meeting ridges 5, 6 of the shell portion has each a peripherally extending inner flange 7, 8. The distance between the flanges 7 and 8 of the shell portions 2, 3 is settled to receive a board 9 which, when used as a display unit, perform the function of a desk top (see especially FIG. 3-6). The board 9 is thus clamped between the flanges 7, 8 in the inside of the storage space and dividing the space into two compartments 4*a*, 4*b*.

Figure 11:
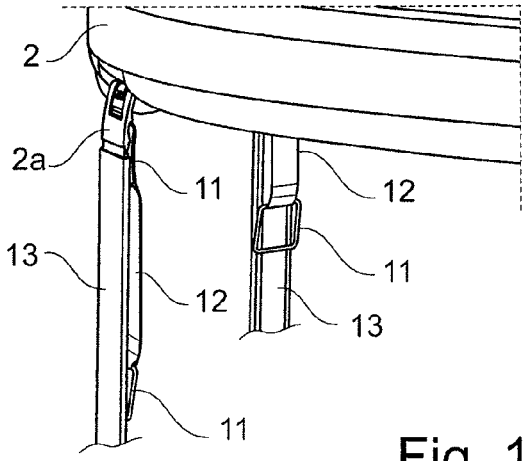
FIG. 11 is a partial perspective view in a greater scale of the upper shell portion of the combined transport and exhibition device when mounted as a transport unit.

Each clasp 2*a*, 3*a* is hinged to respective shell portion 2, 3 and has a grasping groove 2*b* (see FIGS. 9, 10 and 12) a predetermined distance from the hinge axis 10 for engagement of a rod part of a rectangular ring 11 attached at each end of a detachable strap 12, preferably of an elastic material. In FIG. 11, one can see that the straps could be fastened to one of the clasps at one end to facilitate the mounting. A corresponding grove (not shown) is provided on each clasp 3*a* on the other shell portion 3. Each clasp 2*a*, 3*a* is able to be moved from an open position, as in FIG. 10, to a closed position, as in FIG. 9, against the outer surface of the shell portion, thereby tightening said strap.

Figure 3:
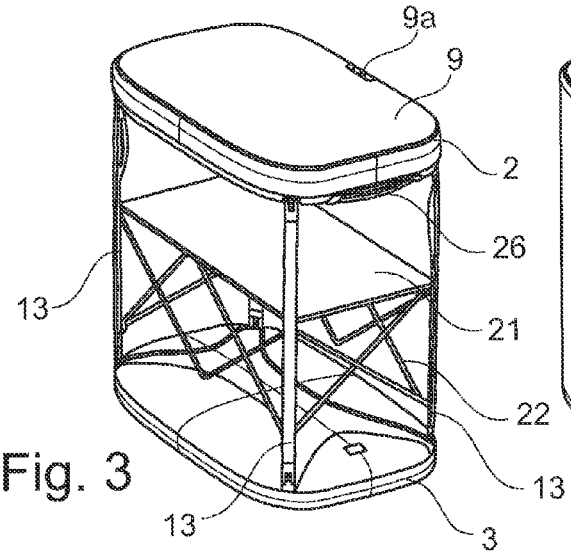
FIG. 3 is a perspective view from above of a combined transport and exhibition device for an exhibition stand according to the invention mounted as a display unit.
Figure 4:
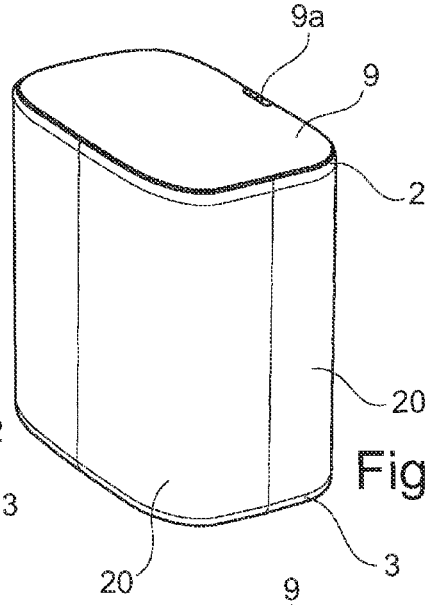
FIG. 4 is a view like FIG. 3, wherein the display unit is covered by posters at the front side thereof.
Figure 5:
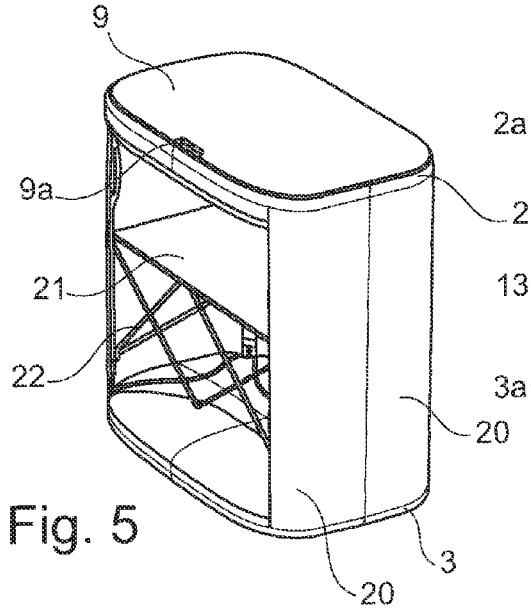
FIG. 5 is a perspective view from above, but from another angle, showing the open back side of the display unit of FIG. 4.
Figure 6:
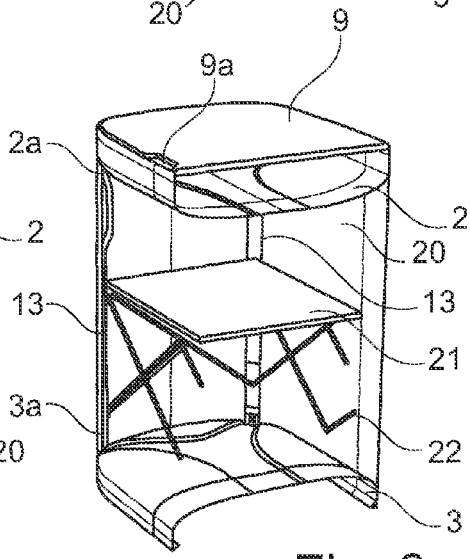
FIG. 6 is a cross-sectional view through the middle of the combined transport and exhibition device of FIG. 5.

When used as a display unit, as is best illustrated in FIGS. 3-5, the shell portions 2, 3 are turned around with the outer surfaces facing each other so that four bars 13 can be connected to and arranged between two oppositely arranged clasp means 2*a* and 3*a* (see FIGS. 10 and 11) on each shell portion 2, 3, thereby forming a display unit for exhibitions or the like. At each end of each bar 13, snap means 13*a* are provided which each is able to receive a releasably connectable hook 14 which is provided at the end of each clasp 2*a*, 3*a*. The snap means 13*a* are mounted in a recess in each end of each bar 13 and are hinged at 30 at the bar 13 and consists of a grip portion 31 at one en which comes to engagement with the hook 14 and at the other end has a helical spring 32 which urges the other end of the snap means 13*a* outwardly to enable engagement of the hook 14 and the Each clasp 2, 3 is provided with a base plate 15 which has two holes through which fasteners 16, such as rivets or screws, are penetrated to fasten the clasps 2*a* and 3*a* at the shell portions 2 and 3, respectively.

Figure 12:
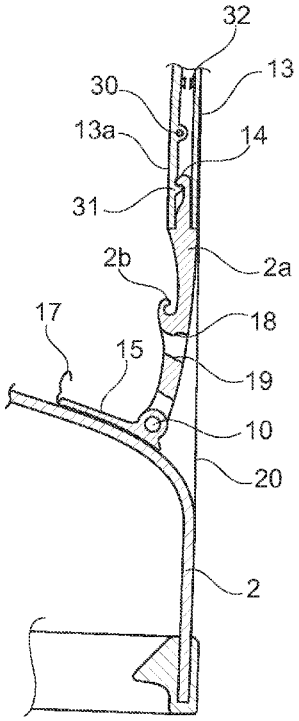
FIG. 12 is a partial section view in a greater scale of the lower shell portion with clasp and bar.

As can be seen in FIG. 12, at the end of the base plate 15 opposite the hinge axis 10 a snap hook 17 is provided which, when the device is mounted as a transport unit, snaps into a recess 18 formed in a hole 19 in each clasp 2*a*, 3*a*.

At least one poster 20 (see FIGS. 4 and 5) are releasably attached in a known manner, e.g., by means of magnetic strips, at the outer periphery of the shell portions 2, 3. The posters 20 can act to stabilize the whole construction., when used as a display unit In the drawings four clasps 2*a*, 3*a* on each shell portion 2, 3 are shown which clasps cooperate with four straps 12, when mounted as a transport unit, and four bars 13, when mounted as a display unit. Of course this number can be altered to any known number or at least two or three with stabilization aid by means of the poster or posters 20, but it is preferred, for the optimal stability of the combined transport and exhibition device 1, to use four clasps 2*a*, 3*a* on each shell portion 2, 3.

It should be noted, that at least one cover board is provided which covers over the open space of the uppermost shell portion when forming a display unit for exhibitions, demonstrations or the like. The board 9 has a recess 9*a* at the middle of one side which is used to lift up the board for getting access to the storage space in the upper shell 2 when used as a display unit. On the opposite side of the board 9 detachable hinges (not shown) could be provided.

Interior fittings, as at least one shelf 21, are mountable within said display unit by means of a framework 22.

Figure 13:
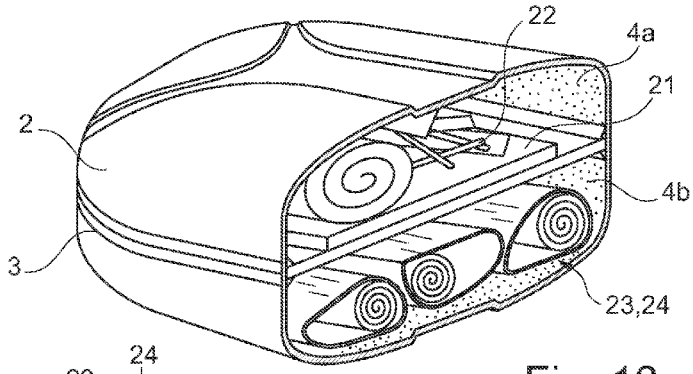
FIG. 13 is a view similar to FIG. 9 of the lower corner of the lower.
Figure 14:
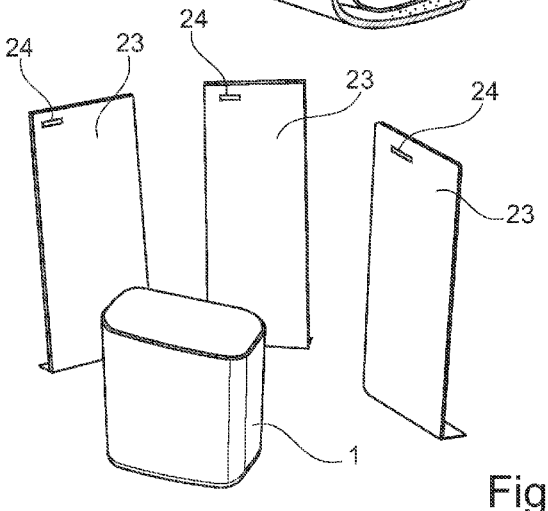
FIG. 14 is a perspective view of an exhibition stand with the combined transport and exhibition device according to the invention

In FIG. 13 a packed device 1 is shown when used as a transport unit. In the upper space 4*a*, above the board 9 equipment material, such as at least one rolled poster 20, at least one shelf 21 and framework for supporting the shelf 21, can be accommodated. In the lower space 4*b*, other exhibition materials such as other, not shown posters, roll-up stands 23 and illumination devices 24 can be accommodated. This means that a substantially complete exhibition stand can be transported within the combined transport and exhibition device 1 according to the invention.

Figure 7:
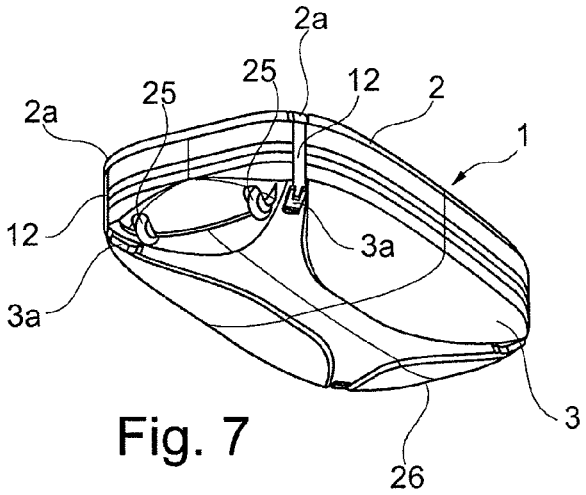
FIG. 7 is a perspective view from below of the combined transport and exhibition device mounted as a transport unit as in FIG. 1.
Figure 8:
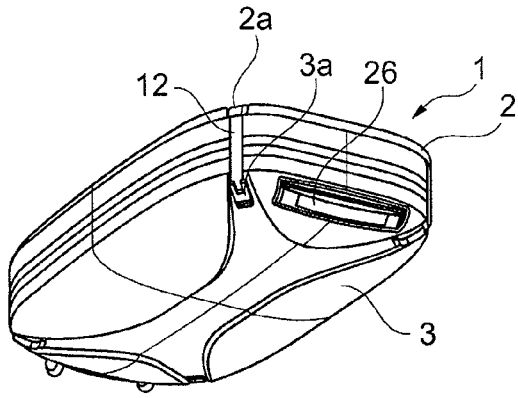
FIG. 8 is a perspective view from below of the combined transport and exhibition device from the opposite side compared with FIG. 7.
Figure 9:
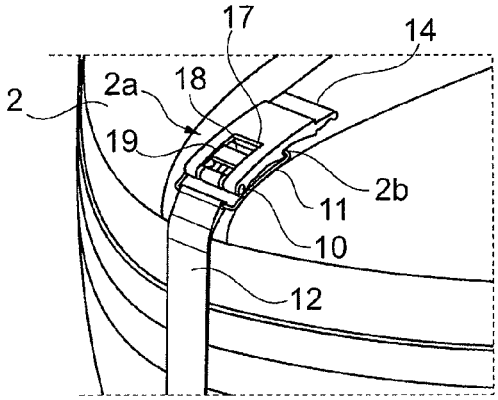
FIG. 9 is a partial perspective view in a greater scale of one corner of the combined transport and exhibition device when mounted as a transport unit.
Figure 10:
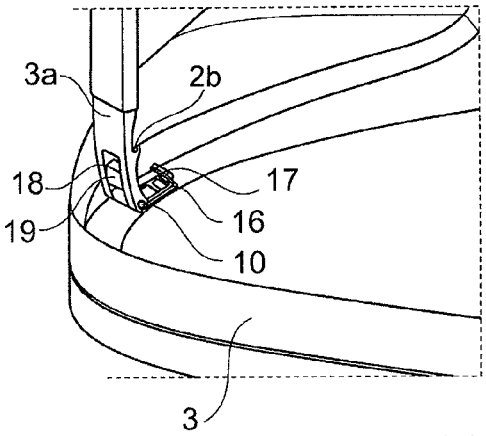
FIG. 10 is a view similar to FIG. 9 of the lower corner of the lower shell portion of the combined transport and exhibition device when mounted as a display unit.

As can be seen in FIGS. 7 and 8, one of the shell portions is provided with wheels 25 and a handle 26 to facilitate transportation of the device 1 when it is mounted as a transport unit.

If no wheels are mounted and when it is referred to the upper and the lower it should be understood that the shells 2 and 3 of the device 1 according to the invention can be identical so that the upper shell 2 can act as the lower shell 3 and vice versa.

It should be noted that the combined transport and exhibition device for an exhibition stand according to the invention is not limited to the above described embodiment, but could be modified within the scope of the appended claims.

The invention claimed is:

1. A combined transport and exhibition device for an exhibition stand comprising:

two matching shell portions;

at least two oppositely arranged clasp means provided on each shell portion to keep said shell portions together and interacting to form a storage space within said tightened shell portions when mounted as a transport unit; and at least two bars which are releasably connectable to said at least two oppositely arranged clasp means on each shell portion when mounted as a display unit to be used as a podium or a desk, said oppositely arranged clasp means being, when mounted as a transport unit, releasably connectable to each other, wherein said oppositely arranged clasp means are, when mounted as a display unit to be used as a podium or a desk, connectable to the ends of said at least two bars with stabilizing help of at least one poster that is releasably fastened on the outside of said shell portions, wherein each one of said clasp means is hinged to respective shell portion and has a grasping groove a predetermined distance from the hinge axis for engagement of a rod part of a rectangular ring attached at each end of a detachable strap, each clasp means being able to be moved to a closed position against the outer surface of said shell portions, thereby tightening said strap to form the storage space.

2. A device according to claim 1, wherein said shell portions are substantially identical in shape and are trough-shaped to form said storage space.

3. A device according to claim 1, wherein the bars are releasably connectable to the end parts of said two oppositely arranged clasp means when mounted as a display unit.

4. A device according to claim 1, wherein the at least one poster is releasably attached at the outer periphery of said shell portions by means of magnetic strips.

5. A device according to claim 1, wherein said shell portions, when mounted as a display unit, are turned around, so that the outer surfaces face each other.

6. A device according to claim 1, wherein a board is provided which covers the open space of the uppermost shell portion when mounted as a display unit.

7. A device according to claim 6, wherein said board is clamped between flanges at an inside periphery ridge of each shell portion when mounted as a transport unit.

8. A device according to claim 1, wherein fitments, as at least one shelf by means of a framework, are mountable within said device when mounted as a display unit.

9. A device according to claim 1, when used as a transport unit, is divided into two inner compartments, wherein one compartment could be used to accommodate materials of the device and the other compartment to accommodate other equipment, as roll-up stands illumination equipment or the like.

10. A device according to claim 1, wherein the detachable strap is formed of an elastic material.

11. A combined transport and exhibition device for an exhibition stand comprising:

two matching shell portions;

at least two oppositely arranged clasp means provided on each shell portion to keep said shell portions together and interacting to form a storage space within said tightened shell portions when mounted as a transport unit; and at least two bars which are releasably connectable to said at least two oppositely arranged clasp means on each shell portion when mounted as a display unit to be used as a podium or a desk, wherein each one of said clasp means is hinged to respective shell portion and has a grasping groove a predetermined distance from the hinge axis for engagement of a rod part of a rectangular ring attached at each end of a detachable strap, each clasp means being able to be moved to a closed position against the outer surface of said shell portions, thereby tightening said strap to form the storage space.

12. A device according to claim 11, wherein the detachable strap is formed of an elastic material.

* * * * *